US011779506B1

(12) United States Patent
Liu

(10) Patent No.: US 11,779,506 B1
(45) Date of Patent: Oct. 10, 2023

(54) CONNECTING ROD SELF-LOCKING STRUCTURE FOR DOUBLE-FOLDED ROLLATOR

(71) Applicant: Zhongshan QUNN Medical Equipment Co., Ltd, Zhongshan (CN)

(72) Inventor: Weiguo Liu, Zhongshan (CN)

(73) Assignee: Zhongshan QUNN Medical Equipment Co., Ltd, Zhongshan (CN)

( * ) Notice: Subject to any disclaimer, the term of this patent is extended or adjusted under 35 U.S.C. 154(b) by 0 days.

(21) Appl. No.: 18/320,125

(22) Filed: May 18, 2023

(30) Foreign Application Priority Data

May 24, 2022 (CN) ..... 202221252993.8

(51) Int. Cl.
*A61H 3/04* (2006.01)

(52) U.S. Cl.
CPC ..... *A61H 3/04* (2013.01); *A61H 2201/0161* (2013.01); *A61H 2201/1638* (2013.01)

(58) Field of Classification Search
CPC ..... A61H 3/04; A61H 2201/0161
See application file for complete search history.

(56) References Cited

U.S. PATENT DOCUMENTS

| | | | | |
|---|---|---|---|---|
| 9,821,827 | B2 * | 11/2017 | Kindberg | B62B 7/062 |
| 9,839,571 | B2 * | 12/2017 | Pan | A47C 4/04 |
| 2007/0267835 | A1 * | 11/2007 | Huang | A61H 3/04 280/87.05 |
| 2022/0395419 | A1 * | 12/2022 | Zhou | A61H 3/04 |

FOREIGN PATENT DOCUMENTS

| | | | | |
|---|---|---|---|---|
| CN | 212824891 | U | 3/2021 | |
| CN | 113545929 | A | 10/2021 | |
| CN | 113552822 | A | 10/2021 | |
| EP | 2366372 | A1 * | 9/2011 | A61H 3/04 |
| EP | 2921151 | B1 * | 11/2016 | A61H 3/04 |
| EP | 3095431 | A1 * | 11/2016 | A61H 3/04 |

* cited by examiner

*Primary Examiner* — Noah Chandler Hawk
(74) *Attorney, Agent, or Firm* — Nitin Kaushik

(57) ABSTRACT

The present invention discloses a connecting rod self-locking structure for a double-folded rollator, comprising a cross pipe and two sets of main frame bottom pipes arranged in parallel to the left and right. A folding plastic seat is movably mounted on the top of the front end of the main frame bottom pipe via a pin shaft, two sides of the bottom of the folding plastic seat are clamped on the side edge of the main frame bottom pipe, the bottom of the cross pipe is movably connected to the folding plastic seat, a connecting rod hook is connected to a connecting rod via a torsion spring, and a limiting column for the connecting rod hook to be buckled is further provided on the upper part of the cross pipe.

3 Claims, 15 Drawing Sheets

CONNECTING ROD SELF-LOCKING STRUCTURE FOR DOUBLE-FOLDED ROLLATOR

CROSS-REFERENCE TO RELATED APPLICATIONS

The application claims priority to Chinese patent application No. 2022212529938, filed on May 24, 2022, the entire contents of which are incorporated herein by reference.

TECHNICAL FIELD

The present invention relates to the technical field of a double-folded four-wheeler, and specifically to a connecting rod self-locking structure for a double-folded rollator.

BACKGROUND

In the production and design of a folding vehicle, it is particularly important that the folded vehicle is easy to carry. However, the folding or unfolding of a folding vehicle in the prior art is cumbersome to use and has many operation steps, so that the folding and unfolding of the frame of the folding vehicle cannot be achieved quickly; the folding vehicle still needs manual locking of the whole frame via a locking hook after unfolding, and the whole structure is unstable. Therefore, we propose a connecting rod self-locking structure for a double-folded rollator.

SUMMARY

The purpose of the present invention is to provide a connecting rod self-locking structure for a double-folded rollator to address the issues proposed in the background art mentioned above.

In order to achieve the above object, the present invention provides the following technical solutions: a connecting rod self-locking structure for a double-folded rollator, comprising a cross pipe and two sets of main frame bottom pipes arranged in parallel to the left and right. The front end and rear end of the main frame bottom pipe are respectively mounted with a front wheel and a rear wheel, the top of the front end of the main frame bottom pipe is movably mounted with a folding plastic seat via a pin shaft, two sides of a bottom of the folding plastic seat are clamped at side edges of the main frame bottom pipe, and a main frame pipe is connected to the folding plastic seat;

the cross pipe comprises two sets of cross pipes, a middle between the two sets of cross pipes is movably connected in an X shape via a connecting pin, the bottom of the cross pipe is movably connected to the folding plastic seat, an upper part of the cross pipe is movably connected to a connecting seat fixed to the side edge of the main frame pipe via two sets of connecting rods, and a cushion pipe sleeve is connected to the top of the cross pipe;

a plastic lock set is movably connected to the tail end of one cushion pipe sleeve, a connecting rod hook is movably connected to the connecting rod at a rear part, the connecting rod hook is connected to the connecting rod via a torsion spring, a limiting column for the connecting rod hook to be buckled is further provided on the upper part of the cross pipe, and a connecting rod hook boss is further provided on a surface of the connecting rod hook;

a cushion is mounted between two sets of cushion pipe sleeves, a drawstring is connected to the cushion, and the bottom of the drawstring is buckled on a corresponding connecting rod hook.

Compared with the prior art, the beneficial effects of the present invention are as follows: after the main frame bottom pipe is externally pulled, the connecting rod hook is under the action of the elastic force of the torsion spring, so that the limiting column slides into the track of the connecting rod hook, automatically completing the self-locking between the connecting rod hook and the limiting column on the cross pipe; at this time, the whole vehicle is in a locked state, the overall structure is stable, and the main frame bottom pipe is not allowed to collapse;

when the drawstring is pulled upwards, one end of the connecting rod hook is pulled upwards by the drawstring, and at this time, the limiting column derails, and the main frame bottom pipe will fold back; after the plastic lock set is locked on the cushion pipe sleeve, it will be gently and forcefully folded downwards to return to the fully folded state, so that the folding is convenient.

Figure 1:
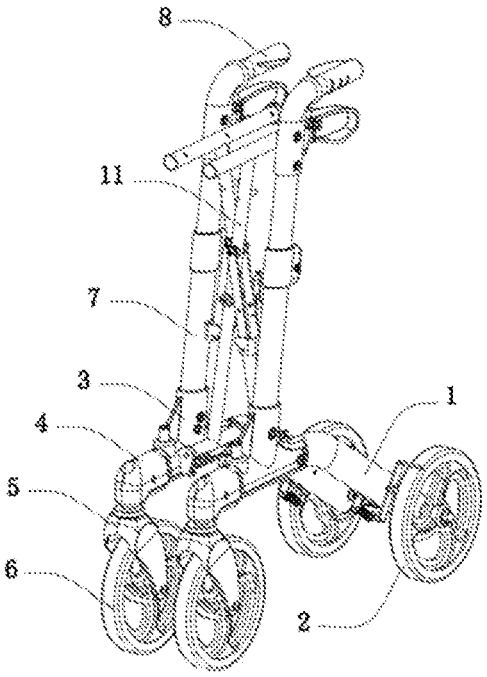
FIG. 1 is a schematic structural diagram of a main frame pipe of the present invention after being unfolded.
Figure 2:
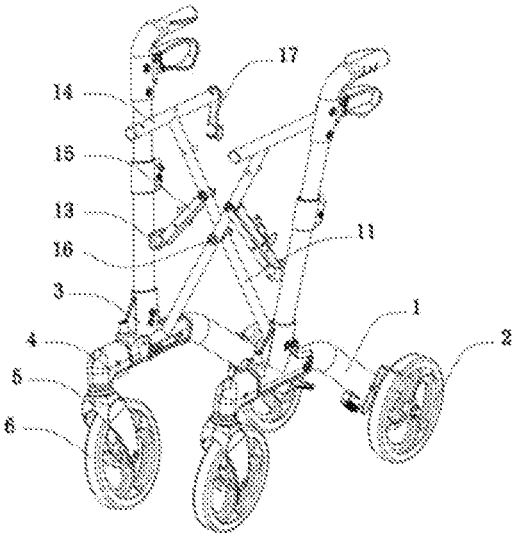
FIG. 2 is a schematic structural diagram of a cross pipe in an unfolded state according to the present invention.

In the figures: 1, a main frame bottom pipe; 2, a rear wheel; 3, a folding plastic seat; 4, a front wheel fixing seat; 5, a universal wheel front fork; 6, a front wheel; 7, a main frame pipe; 8, a butterfly grip; 9, a cushion; 10, a drawstring; 11, a crossed pipe; 12, a connecting rod hook boss; 13, a connecting seat; 14, a cushion pipe sleeve; 15, a connecting rod; 16, a connecting pin; 17, a plastic lock set; 18, a limiting column; 19, a connecting rod hook; and 20, a torsion spring.

DETAILED DESCRIPTION OF THE EMBODIMENTS

The technical solutions in the embodiments of the present invention will be clearly and completely described below in conjunction with the accompanying drawings in the embodiments of the present invention. Obviously, the described embodiments are only a part of the embodiments of the present invention, rather than all the embodiments. Based on the embodiments of the present invention, all other embodiments obtained by one of ordinary skills in the art without involving any inventive effort are within the scope of the present invention.

With reference to FIGS. 1-15, the present invention provides a technical solution: a connecting rod self-locking structure for a double-folded rollator including a cross pipe and two sets of main frame bottom pipes 1 arranged in parallel to the left and right. A front wheel 6 and a rear wheel 2 are respectively mounted at the front end and the rear end of the main frame bottom pipe 1, the front wheel 6 is movably mounted on a universal wheel front fork 5, the top of the universal wheel front fork 5 is mounted on the bottom of a front wheel fixing seat 4, and the front wheel fixing seat 4 is sleeved and fixed on the front end of the main frame bottom pipe 1.

A folding plastic seat 3 is movably mounted on the top of the front end of the main frame bottom pipe 1 via a pin shaft, two sides of the bottom of the folding plastic seat 3 are clamped on the side edge of the main frame bottom pipe 1, a main frame pipe 7 is connected to the folding plastic seat 3, and a butterfly grip 8 is mounted on the top of the main frame pipe 7:

the cross pipe comprises two sets of cross pipes 11, and the middle between the two sets of cross pipes 11 is movably connected in an X shape via a connecting pin 16; the bottom of the cross pipe 11 is movably connected to the folding plastic seat 3; the upper part of the cross pipe 11 is movably connected to a connecting seat 13 fixed at the side edge of the main frame pipe 7 via two sets of connecting rods 15; the connecting seat 13 is welded to the inner side edge of the main frame pipe 7; a cushion pipe sleeve 14 is connected to the top of the cross pipe 11.

A plastic lock set 17 is movably connected to the tail end of one cushion pipe sleeve 14, a connecting rod hook 19 is movably connected to a connecting rod 15 at the rear, the connecting rod hook 19 is connected to the connecting rod 15 via a torsion spring 20, a limiting column 18 for the connecting rod hook 19 to be buckled is further provided on the upper part of the cross pipe 11, and a connecting rod hook boss 12 is further provided on the surface of the connecting rod hook 19;

a cushion 9 is mounted between the two sets of cushion pipe sleeves 14, a drawstring 10 is connected to the cushion 9, and the bottom of the drawstring 10 is buckled on a corresponding connecting rod hook 19.

Specifically, in use, FIGS. 1 to 4 illustrate the opening process of a double-folded four-wheeler.

Figure 3:
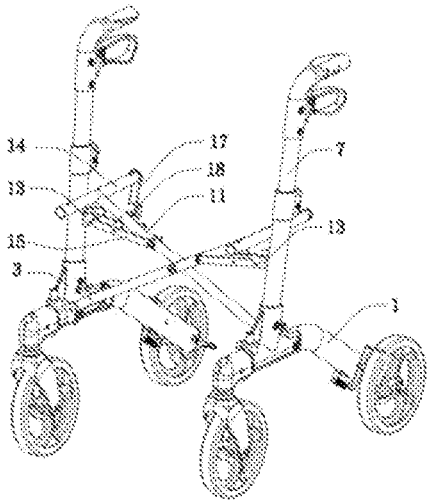
FIG. 3 is a schematic structural diagram of a cross pipe of the present invention after being unfolded.
Figure 4:
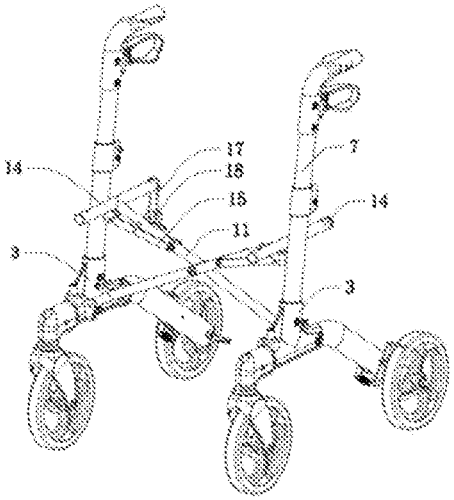
FIG. 4 is a schematic structural diagram of a limiting column sliding into a connecting rod hook track according to the present invention.
Figure 5:
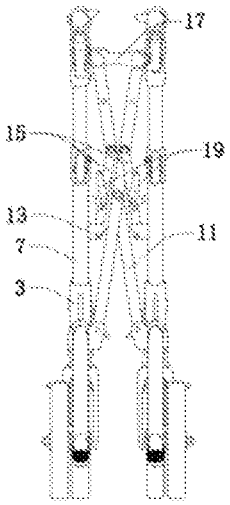
FIG. 5 is a schematic structural diagram of a main frame bottom pipe assembly in a pull-up state according to the present invention.
Figure 6:
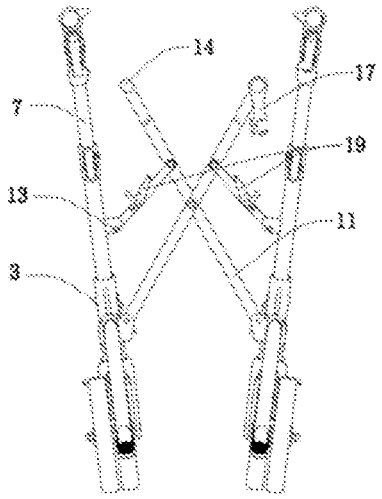
FIG. 6 is a schematic structural diagram of a main frame bottom pipe assembly in an external pulling state according to the present invention.
Figure 7:
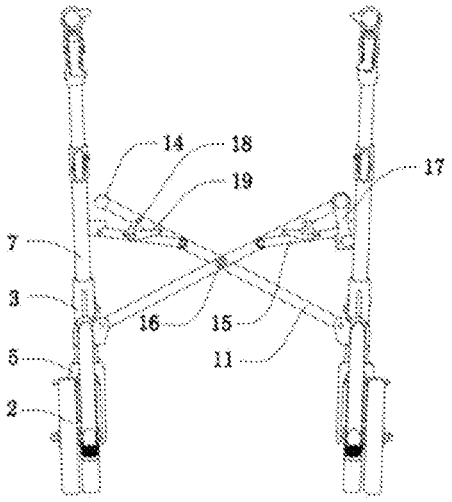
FIG. 7 is a schematic structural diagram of a connecting rod hook in a preparatory locking state in the process of external pulling of a main frame bottom pipe assembly according to the present invention.
Figure 8:
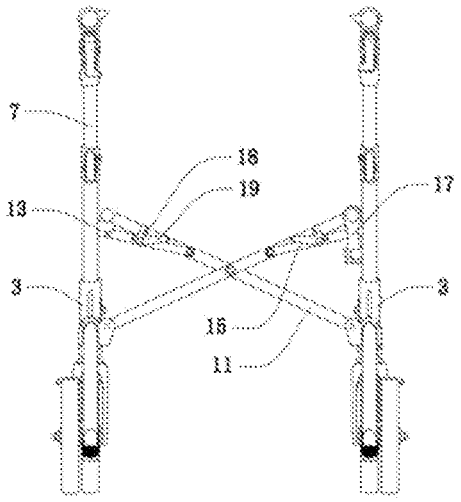
FIG. 8 is a schematic structural diagram of a connecting rod hook in a locked state according to the present invention.
Figure 9:
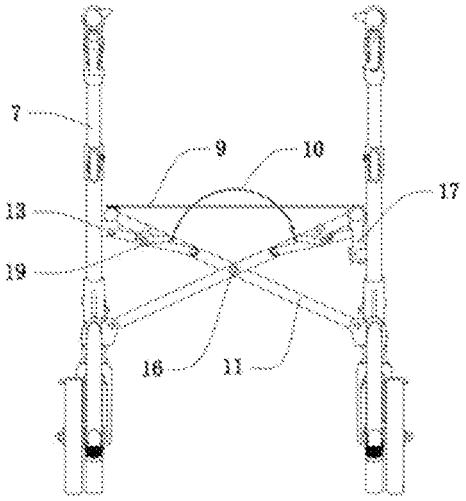
FIG. 9 is a schematic structural diagram in a use state according to the present invention.
Figure 10:
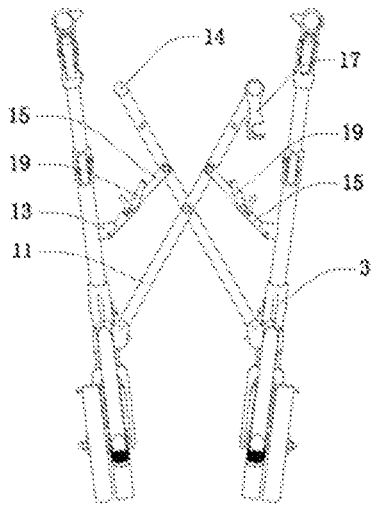
FIG. 10 is a schematic structural diagram of the first folding back state according to the present invention.
Figure 11:
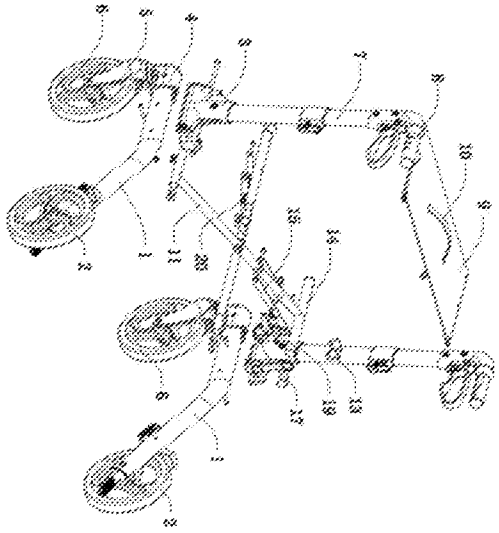
FIG. 11 is a schematic diagram of a wholly exploded first three-dimensional structure of the present invention.
Figure 12:
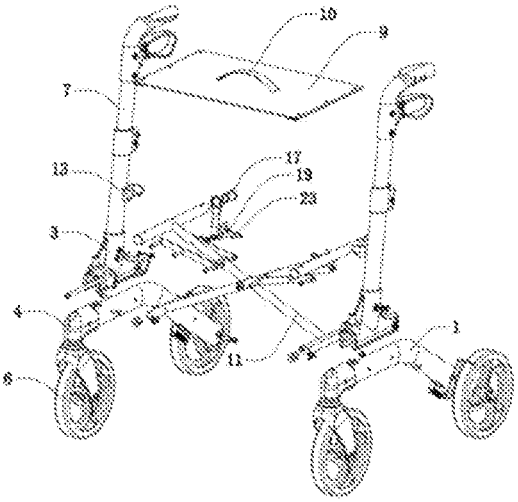
FIG. 12 is a schematic diagram of a wholly exploded second three-dimensional structure of the present invention.
Figure 13:
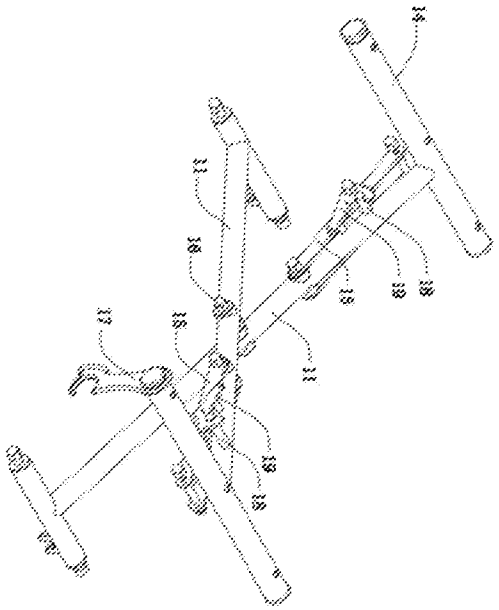
FIG. 13 is a schematic structural diagram of a connecting rod hook and a limiting column in the locked state when the cross pipe is unfolded according to the present invention.

After the plastic lock set 17 is opened in FIG. 1, when the main frame bottom pipe 1 is pulled out to FIG. 3, the connecting rod hook 19 is under the elastic force of the torsion spring 20, so that the limiting column 18 slides into the track of the connecting rod hook 19. When the limiting column 18 slides into the state of FIG. 4 according to the track, under the action of the torsion spring 20, the connecting rod hook boss 12 presses on the cross pipe 11, and the other end of the connecting rod hook 19 buckles the limiting column 18 on the cross pipe. At this time, the whole vehicle is in a locked state, and the main frame bottom pipe 1 is not allowed to collapse;

FIGS. 5 to 9 show a folding back process of a double-folded four-wheeler.

Figure 14:
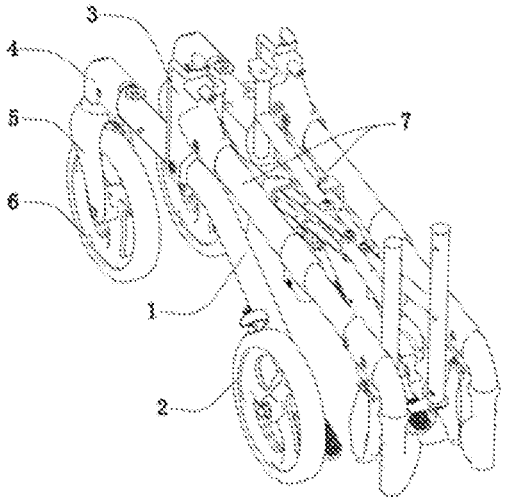
FIG. 14 is a schematic structural diagram of the present invention after being folded.
Figure 15:
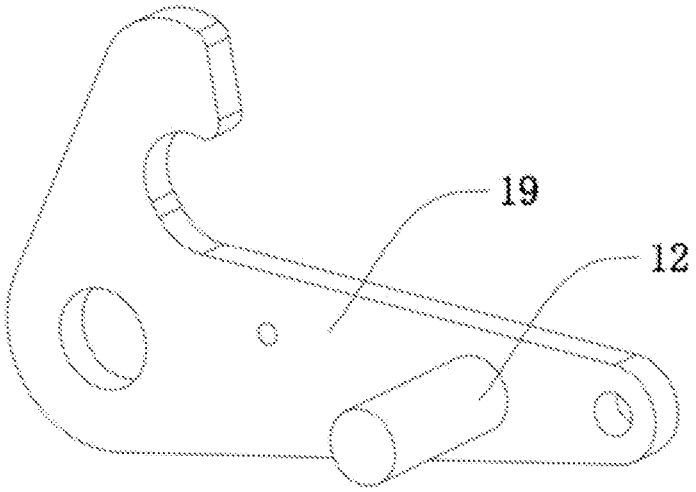
FIG. 15 is a schematic diagram of a three-dimensional structure of a connecting rod hook boss and a connecting rod hook connection according to the present invention.

When the drawstring 10 is pulled upwards, one end of the connecting rod hook 19 is pulled upwards by the drawstring 10, and at this time, the limiting column 18 derails, and the main frame bottom pipe 1 will fold back; after the plastic lock set 17 locks the cushion pipe sleeve 14, it is gently and forcibly folded downwards to return to the state of FIG. 14.

While embodiments of the present invention have been shown and described, it will be understood by those skilled in the art that various changes, modifications, substitutions, and alterations may be made to these embodiments without departing from the principles and spirit of the present invention, and the scope of the present invention is limited by the attached claims and equivalents thereof.

What is claimed is:

1. A connecting rod self-locking structure for a double-folded rollator, comprising a cross pipe and two sets of main frame bottom pipes (1) arranged in parallel to the left and right, wherein a front end and a rear end of the main frame bottom pipe (1) are respectively mounted with a front wheel (6) and a rear wheel (2), a top of the front end of the main frame bottom pipe (1) is movably mounted with a folding plastic seat (3) via a pin shaft, two sides of a bottom of the folding plastic seat (3) are clamped at side edges of the main frame bottom pipe (1), and a main frame pipe (7) is connected to the folding plastic seat (3);

the cross pipe comprises two sets of cross pipes (11), a middle between the two sets of cross pipes (11) is movably connected in an X shape via a connecting pin (16), the bottom of the cross pipe (11) is movably connected to the folding plastic seat (3), an upper part of the cross pipe (11) is movably connected to a connecting seat (13) fixed to the side edge of the main frame pipe (7) via two sets of connecting rods (15), and a cushion pipe sleeve (14) is connected to the top of the cross pipe (11);

a plastic lock set (17) is movably connected to a tail end of one cushion pipe sleeve (14), a connecting rod hook (19) is movably connected to the connecting rod (15) at a rear part, the connecting rod hook (19) is connected to the connecting rod (15) via a torsion spring (20), a limiting column (18) for the connecting rod hook (19) to be buckled is further provided on the upper part of the cross pipe (11), and a connecting rod hook boss (12) is further provided on a surface of the connecting rod hook (19);

a cushion (9) is mounted between two sets of cushion pipe sleeves (14), a drawstring (10) is connected to the cushion (9), and the bottom of the drawstring (10) is buckled on a corresponding connecting rod hook (19).

2. The connecting rod self-locking structure for a double-folded rollator according to claim 1, wherein the front wheel (6) is movably mounted on a universal wheel front fork (5), the top of the universal wheel front fork (5) is mounted to the bottom of a front wheel fixing seat (4), and the front wheel fixing seat (4) is sleeved and fixed on the front end of the main frame bottom pipe (1).

3. The connecting rod self-locking structure for a double-folded rollator according to claim 1, wherein a butterfly grip (8) is mounted on the top of the main frame pipe (7), and the connecting seat (13) is welded to an inner side edge of the main frame pipe (7).

* * * * *